US009959731B2

(12) United States Patent
Kolla et al.

(10) Patent No.: US 9,959,731 B2
(45) Date of Patent: *May 1, 2018

(54) DYNAMIC PERIMETER ALERT SYSTEM

(71) Applicant: International Business Machines Corporation, Armonk, NY (US)

(72) Inventors: Jhansi R. Kolla, Morrisville, NC (US); Paul J. O'Donnell, Springville, UT (US); Michael S. Thomason, Raleigh, NC (US)

(73) Assignee: International Business Machines Corporation, Armonk, NY (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/423,621

(22) Filed: Feb. 3, 2017

(65) Prior Publication Data

US 2017/0148295 A1 May 25, 2017

Related U.S. Application Data

(63) Continuation of application No. 14/835,880, filed on Aug. 26, 2015, now Pat. No. 9,600,992.

(51) Int. Cl.
*G08B 1/08* (2006.01)
*G08B 21/02* (2006.01)

(52) U.S. Cl.
CPC ..... *G08B 21/0261* (2013.01); *G08B 21/0236* (2013.01); *G08B 21/0266* (2013.01); *G08B 21/0269* (2013.01)

(58) Field of Classification Search
CPC ..... G08B 21/0261; G08B 21/0266; G08B 21/0269; G08B 21/0202; G08B 21/0205;
(Continued)

(56) References Cited

U.S. PATENT DOCUMENTS 5,298,883 A 3/1994 Pilney et al.
5,963,130 A 10/1999 Schlager et al.
(Continued)

FOREIGN PATENT DOCUMENTS

WO 0043963 A1 7/2000
WO 0065550 A1 11/2000
WO 2008152688 A1 12/2008

OTHER PUBLICATIONS

Imoastsky, "iMoastsky Child Alarm Bracelet Anti Lost Wristband Anti Lost Alarm Safety Security for Baby Pet Purse", provided in evaluation of disclosure dated May 9, 2014, 8 pages, <http://smile.amazon.com/iMoastsky-Bracelet-Wristband-Safety-Security/dp/B00J2RSY1Y/ref=sr_1_15?ie=UTF8&qid=1426706578&sr=8-15&keywords=child+alert+bracelet—Adjustable 0-25 meters to search the lost kid>.

(Continued)

*Primary Examiner* — John A Tweel, Jr.
(74) *Attorney, Agent, or Firm* — Steven F. McDaniel; David B. Woycechowsky

(57) ABSTRACT

A system for making sure that two wireless devices (a perimeter-anchoring device and a constrained device) are not separated too far apart by having a dynamic perimeter that follows the perimeter-anchoring device as it moves. In some embodiments, the size and/or shape of the perimeter is controlled by machine logic based rules, based at least in part, upon a set of environmental factor(s). Some possible environmental factors include: line of sight, pollution, noise level, presence of stranger(s), streets, traffic, body(ies) of water, contamination, allergen, or blocking obstruction(s).

18 Claims, 5 Drawing Sheets

(58) Field of Classification Search
CPC ..... G08B 21/0236; G08B 21/0283; G08B 13/1427
USPC ..... 340/539.15
See application file for complete search history.

(56) References Cited

U.S. PATENT DOCUMENTS

| | | | | |
|---|---|---|---|---|
| 5,987,379 | A | 11/1999 | Smith | |
| 6,243,039 | B1 | 6/2001 | Elliot | |
| 6,271,757 | B1 | 8/2001 | Touchton et al. | |
| 6,510,380 | B1 | 1/2003 | Curatolo et al. | |
| 7,259,682 | B2 | 8/2007 | Vannerus et al. | |
| 7,511,627 | B2 | 3/2009 | Holoyda | |
| 9,600,992 | B1 * | 3/2017 | Kolla | G08B 21/0261 |
| 2007/0247307 | A1 | 10/2007 | Riep | |
| 2010/0295483 | A1 | 11/2010 | Ashoff et al. | |
| 2012/0179374 | A1 | 7/2012 | Jensen et al. | |
| 2012/0284769 | A1 | 11/2012 | Dixon et al. | |
| 2012/0306660 | A1 | 12/2012 | Stopel et al. | |
| 2013/0183924 | A1 | 7/2013 | Saigh et al. | |
| 2015/0022337 | A1 | 1/2015 | Gettings et al. | |

OTHER PUBLICATIONS

Kuloglu et al., "Counter-Intelligence as a Chaotic Phenomenon and Its Importance in National Security", S. Banerjee et al. (eds.), Chaos Theory in Politics, Understanding Complex Systems, DOI 10.1007/978-94-017-8691-1_11, © Springer Science + Business Media Dordrecht 2014, pp. 171-188.

O'Donnell, Andy, "Keep Track of Your Kids With Geofences", 7 pages, provided in evaluation of disclosure dated May 9, 2014, <http://netsecurity.about.com/od/newsandeditoria2/a/Keeping-Tabs-On-Your-Kids-With-Geofences.htm>.

Pongpaichet et al., "Situation Fencing: Making Geo-Fencing Personal and Dynamic", In Proceedings of the 1st ACM International Workshop on Personal Data Meets Distributed Multimedia, pp. 3-10, ACM, 2013.

"Tour—Set up geofence", Parental Control Board, provided in evaluation of disclosure dated May 9, 2014, 3 pages, <https://parentalboard.com/tour/set-up-geofence>.

Kolla et al., "Dynamic Perimeter Alert System", U.S. Appl. No. 14/835,880, filed Aug. 26, 2015, 32 pages.

IBM, List of Patent Applications Treated as Related, Appendix P, Feb. 2, 2017, 2 pages.

* cited by examiner

NETWORKED COMPUTER SYSTEM, 100
PERIMETER ANCHORING DEVICE, 104
GPS MOD, 110
E/F MOD, 120
CONSTRAINED DEVICE, 106
GPS MOD, 112
E/F MOD, 122
NETWORK, 114
SERVER SUB-SYSTEM, 102
SERVER COMPUTER, 200
COMMUNICATION UNIT, 202
MEMORY, 208
RAM, 230
CACHE, 232
PERSISTENT STORAGE, 210
PROGRAM, 300
PROCESSOR SET, 204
I/O INTERFACE SET, 206
DISPLAY, 212
EXTERNAL DEVICES, 214

DYNAMIC PERIMETER ALERT SYSTEM

BACKGROUND

The present invention relates generally to the field of systems that use wireless devices to determine information relating to geographic location (such as separation between two people), and more particularly to child locator systems.

U.S. Pat. No. 7,511,627 ("Holoyda") states as follows: "A child locator that enables a parent to locate a child includes a master unit for wear by a parent and a monitored unit for wear by a child. The master unit may actuate an on-board alarm when its processor determines that the monitored unit is beyond a first predetermined distance and may actuate an alarm on the monitored unit when the separation distance is beyond another distance. The first and second predetermined distances may be the same of different. The child locator may also actuate the monitored unit manually and the alarms may be audible or visual."

SUMMARY

According to an aspect of the present invention, there is a method, computer program product and/or system that performs the following operations (not necessarily in the following order): (i) providing a perimeter-anchoring device and a constrained device, with each of the perimeter-anchoring and constrained devices being structured, sized and/or shaped to be portable, and including a location determination module structured and/or programmed to determine a current geographic location of the device; (ii) receiving, from the location determination module of the perimeter-anchoring device, the current location of the perimeter-anchoring device; (iii) determining, by a perimeter module on an on-going basis, a geographic area surrounding the perimeter-anchoring device, with the geographic area being bounded by a perimeter so that the area and perimeter will dynamically move with any movements of the current location of the perimeter-anchoring device; (iv) receiving, from the location determination module of the constrained device, the current location of the constrained device; (v) determining, by a comparison module, whether the constrained device is located outside of the perimeter based upon the current location of the constrained device and a current location of the perimeter surrounding the perimeter-anchoring device; and (vi) on condition that the constrained device is located outside of the perimeter, performing, by an alerting module, a responsive action.

DETAILED DESCRIPTION

Figure 1:
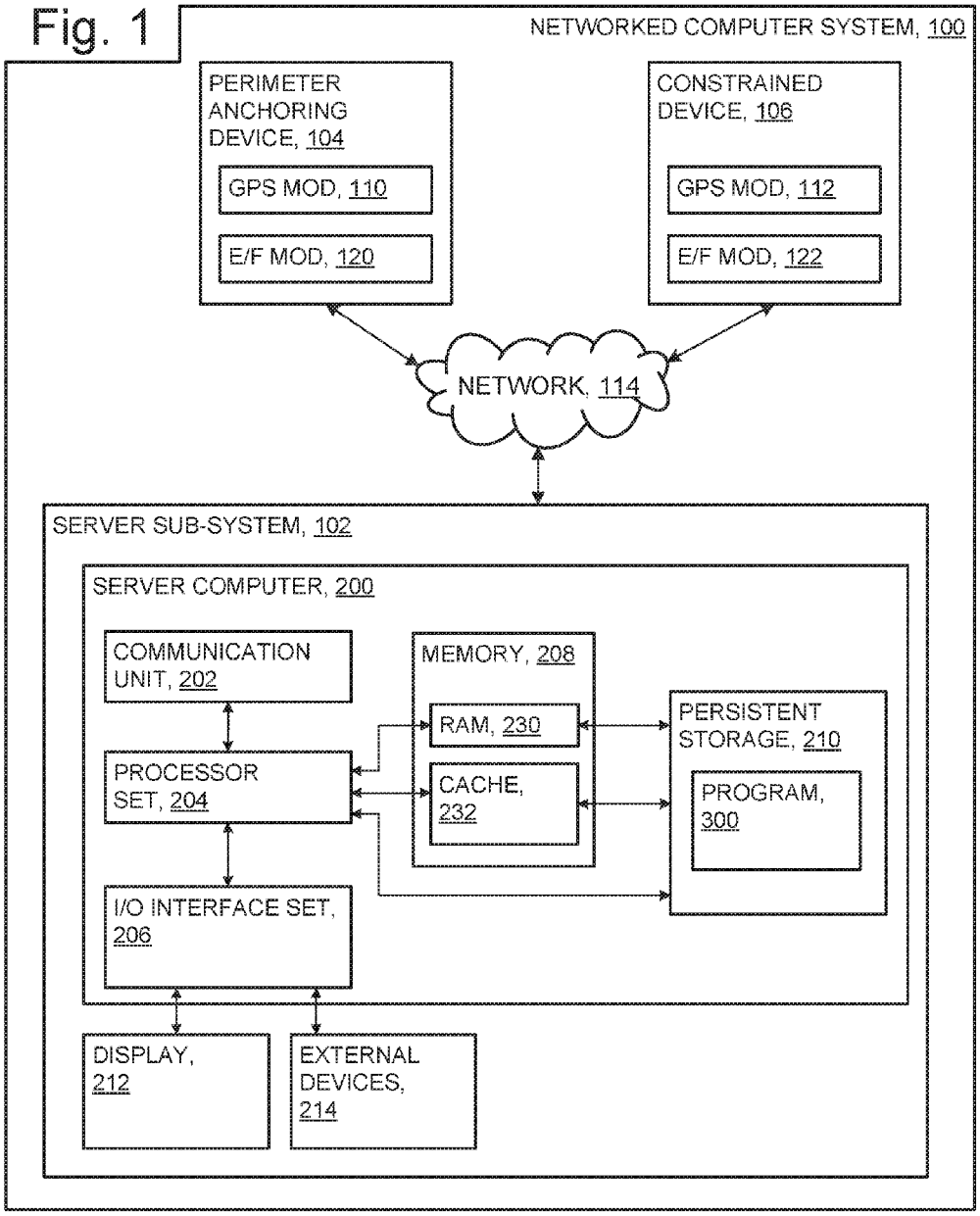
FIG. 1 is a block diagram view of a first embodiment of a system according to the present invention.

Some embodiments of the present disclosure are directed to a system for making sure that two wireless devices (a perimeter-anchoring device and a constrained device) are not separated too far apart by having a dynamic perimeter that follows the perimeter-anchoring device as it moves. In some embodiments, the size and/or shape of the perimeter is controlled by machine logic based rules based on a set of environmental factor(s). Some possible environmental factors include: line of sight, pollution, noise level, presence of stranger(s), streets, traffic, body(ies) of water, contamination, allergen, or blocking obstruction(s). This Detailed Description section is divided into the following sub-sections: (i) The Hardware and Software Environment; (ii) Example Embodiment; (iii) Further Comments and/or Embodiments; and (iv) Definitions.

I. THE HARDWARE AND SOFTWARE ENVIRONMENT

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

An embodiment of a possible hardware and software environment for software and/or methods according to the present invention will now be described in detail with reference to the Figures. FIG. 1 is a functional block diagram illustrating various portions of networked computers system 100, including: server sub-system 102; perimeter anchoring device 104; constrained device 106; communication network 114; server computer 200; communication unit 202; processor set 204; input/output (I/O) interface set 206; memory device 208; persistent storage device 210; display device 212; external device set 214; random access memory (RAM) devices 230; cache memory device 232; and program 300. In this embodiment, perimeter anchoring device 104 is a smartphone equipped with GPS module 110 (a type of "location determination module") and machine logic in the form of environmental factors module 120. In this embodiment, constrained device 106 is a smartphone equipped with GPS module 112 (a type of "location determination module") and machine logic in the form of environmental factors module 122.

Sub-system 102 is, in many respects, representative of the various computer sub-system(s) in the present invention. Accordingly, several portions of sub-system 102 will now be discussed in the following paragraphs.

Sub-system 102 may be a laptop computer, tablet computer, netbook computer, personal computer (PC), a desktop computer, a personal digital assistant (PDA), a smart phone, or any programmable electronic device capable of communicating with the client sub-systems via network 114. Program 300 is a collection of machine readable instructions and/or data that is used to create, manage and control certain software functions that will be discussed in detail, below, in the Example Embodiment sub-section of this Detailed Description section.

Sub-system 102 is capable of communicating with other computer sub-systems via network 114. Network 114 can be, for example, a local area network (LAN), a wide area network (WAN) such as the Internet, or a combination of the two, and can include wired, wireless, or fiber optic connections. In general, network 114 can be any combination of connections and protocols that will support communications between server and client sub-systems.

Sub-system 102 is shown as a block diagram with many double arrows. These double arrows (no separate reference numerals) represent a communications fabric, which provides communications between various components of sub-system 102. This communications fabric can be implemented with any architecture designed for passing data and/or control information between processors (such as microprocessors, communications and network processors, etc.), system memory, peripheral devices, and any other hardware components within a system. For example, the communications fabric can be implemented, at least in part, with one or more buses.

Memory 208 and persistent storage 210 are computer-readable storage media. In general, memory 208 can include any suitable volatile or non-volatile computer-readable storage media. It is further noted that, now and/or in the near future: (i) external device(s) 214 may be able to supply, some or all, memory for sub-system 102; and/or (ii) devices external to sub-system 102 may be able to provide memory for sub-system 102.

Program 300 is stored in persistent storage 210 for access and/or execution by one or more of the respective computer processors 204, usually through one or more memories of memory 208. Persistent storage 210: (i) is at least more persistent than a signal in transit; (ii) stores the program (including its soft logic and/or data), on a tangible medium (such as magnetic or optical domains); and (iii) is substantially less persistent than permanent storage. Alternatively, data storage may be more persistent and/or permanent than the type of storage provided by persistent storage 210.

Program 300 may include both machine readable and performable instructions and/or substantive data (that is, the type of data stored in a database). In this particular embodiment, persistent storage 210 includes a magnetic hard disk drive. To name some possible variations, persistent storage 210 may include a solid state hard drive, a semiconductor storage device, read-only memory (ROM), erasable programmable read-only memory (EPROM), flash memory, or any other computer-readable storage media that is capable of storing program instructions or digital information.

The media used by persistent storage 210 may also be removable. For example, a removable hard drive may be used for persistent storage 210. Other examples include optical and magnetic disks, thumb drives, and smart cards that are inserted into a drive for transfer onto another computer-readable storage medium that is also part of persistent storage 210.

Communications unit 202, in these examples, provides for communications with other data processing systems or devices external to sub-system 102. In these examples, communications unit 202 includes one or more network interface cards. Communications unit 202 may provide communications through the use of either or both physical and wireless communications links. Any software modules discussed herein may be downloaded to a persistent storage device (such as persistent storage device 210) through a communications unit (such as communications unit 202).

I/O interface set 206 allows for input and output of data with other devices that may be connected locally in data communication with server computer 200. For example, I/O interface set 206 provides a connection to external device set 214. External device set 214 will typically include devices such as a keyboard, keypad, a touch screen, and/or some other suitable input device. External device set 214 can also include portable computer-readable storage media such as, for example, thumb drives, portable optical or magnetic disks, and memory cards. Software and data used to practice embodiments of the present invention, for example, program 300, can be stored on such portable computer-readable storage media. In these embodiments the relevant software may (or may not) be loaded, in whole or in part, onto persistent storage device 210 via I/O interface set 206. I/O interface set 206 also connects in data communication with display device 212.

Display device 212 provides a mechanism to display data to a user and may be, for example, a computer monitor or a smart phone display screen.

The programs described herein are identified based upon the application for which they are implemented in a specific embodiment of the invention. However, it should be appreciated that any particular program nomenclature herein is used merely for convenience, and thus the invention should not be limited to use solely in any specific application identified and/or implied by such nomenclature.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

II. EXAMPLE EMBODIMENT

Figure 2:
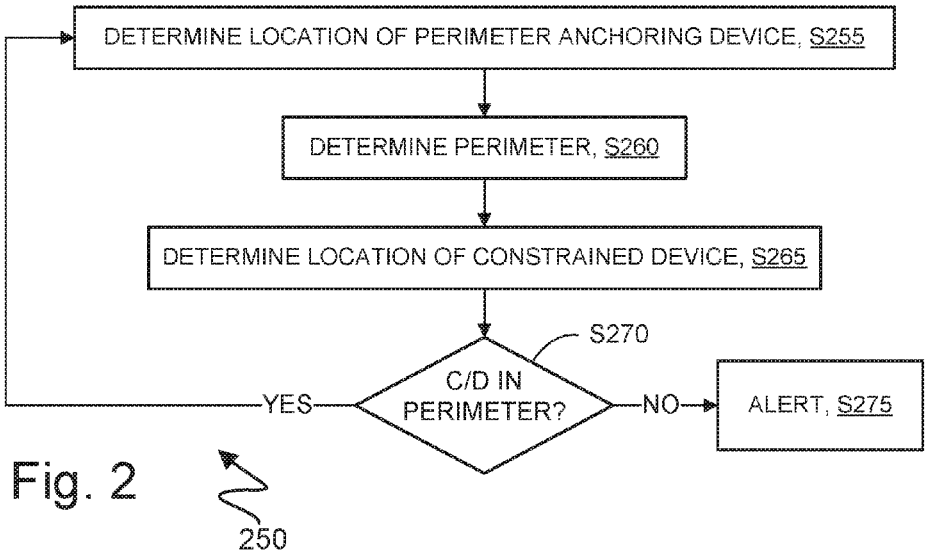
FIG. 2 is a flowchart showing a first embodiment method performed, at least in part, by the first embodiment system.
Figure 3:
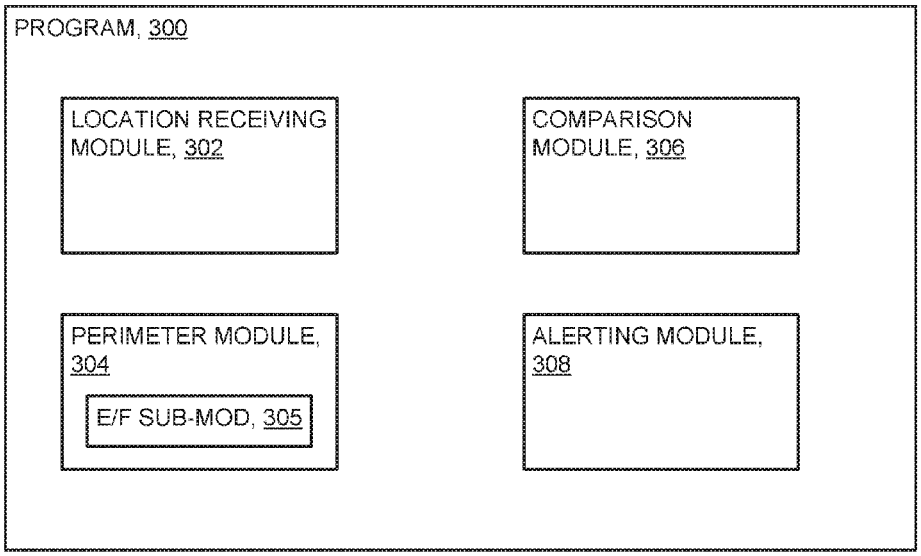
FIG. 3 is a block diagram showing a machine logic (for example, software) portion of the first embodiment system.

FIG. 2 shows flowchart 250 depicting a method according to the present invention. FIG. 3 shows program 300 for performing at least some of the method operations of flowchart 250. This method and associated software will now be discussed, over the course of the following paragraphs, with extensive reference to FIG. 2 (for the method operation blocks) and FIG. 3 (for the software blocks).

Figure 4A:
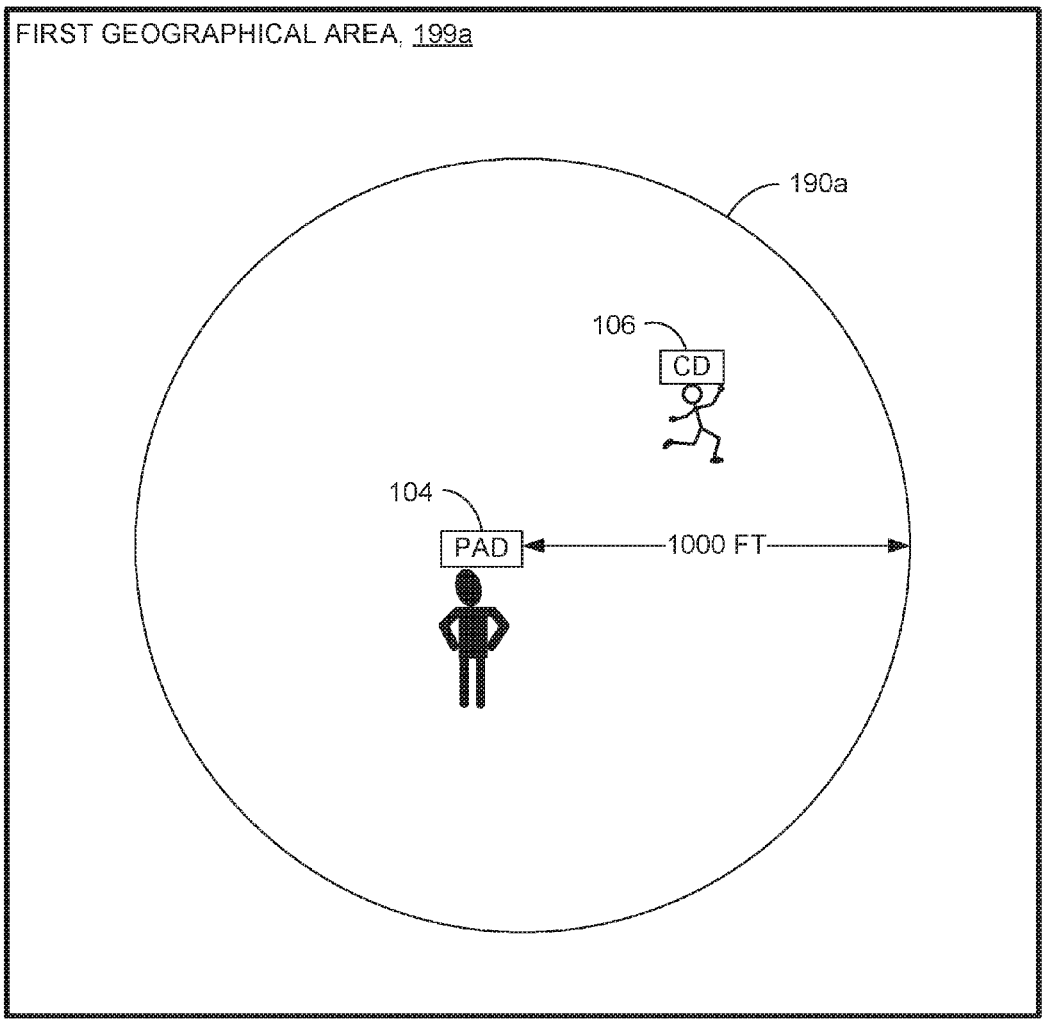
FIG. 4A is a view of people using the first embodiment system at a first geographic location.

Processing begins at operation S255, where: (i) GPS module ("mod") 110 of perimeter anchoring device 104 determines the geographic location of perimeter anchoring device 104; and (ii) perimeter anchoring device 104 sends the current location of the perimeter anchoring device to location receiving mod 302 of program 300. As shown in FIG. 4A, at time T1, perimeter anchoring device 104 (which is portable and subject to movement) is mounted on a parent (no separate reference number) who is located near the center of first geographic area 199*a*. It should be understood that the term "geographic area": (i) may include man-made structures, such as buildings and road; and (ii) the geographic area may, or may not, take into account elevational, or vertical distances, such as vertical distances between floors of a building.

Processing proceeds to operation S260, where perimeter module 304 of program 300 determines a current area and corresponding perimeter defining the area. In this embodiment, the perimeter anchoring device will always be inside of the perimeter. Alternatively, there may be embodiments where the perimeter anchoring device is not inside the perimeter—however, in these embodiments the perimeter will be defined with respect to the current location of the perimeter anchoring device. As shown in FIG. 4A, at time T1, mod 304 determines: (i) the appropriate shape of the perimeter (that is, perimeter 190*a* shown in FIG. 4A) to be a circle with perimeter anchoring device at its center; and (ii) the appropriate size of perimeter 190*a* to be 1000 feet in radius. In this example: (i) a circle is the default shape of the perimeter when environmental factors (to be further discussed below) indicate a geographic area that is relatively safe; and (ii) 1000 feet is a maximum that has been selected by the parent carrying perimeter anchoring device 104. Alternatively, other shapes (including three dimensional "shapes," and/or other sizes may be set as defaults.

Processing proceeds to operation S265, where location receiving mod 302 receives a current location of constrained device 106 from GPS mod 112 of constrained device 106 through network 114 (see FIG. 1). As shown in FIG. 4A, at time T1, constrained device 106 (which is portable and subject to movement) is mounted on a child (no separate reference number) who is running through first geographic area 199*a*, which is a geographic area of relative safety.

Processing proceeds to operation S270, where comparison mod 306 determines whether constrained device 106 (see FIG. 1) is outside of the perimeter previously determined at operation S260. As shown in FIG. 4A, at time T1, constrained device 106 is indeed inside perimeter 190*a*. This means that processing loops back to operation S255 and thence through operations S260 and S265. In this way, some embodiments of the present invention dynamically determine whether an alert (or other responsive action) needs to be performed on an on-going basis as the perimeter anchoring device and/or constrained device move over a larger geography.

At time T2 (shown in FIG. 4B), operation S255 determines that perimeter anchoring device 104 has moved to the center of second geographic area 199*b*. Processing proceeds again to operation S260, but this time perimeter 190*b* is determined based, at least in part upon three "environmental factors" that will now be discussed in the next three paragraphs.

First, environmental factors module 120 (see FIG. 1) of perimeter anchoring device 104 determines that the environmental factor of noise is at a relatively high level. This means that the child may not be able to hear the parent calling. This determination of high noise level is sent to perimeter mod 304, which uses its machine logic based rules (not separately shown in the Figures) to shrink the default perimeter radius of 1000 feet down to 300 feet (see top, left quadrant of perimeter 190*b* in FIG. 4B).

Second, environmental factor module 122 (see FIG. 1) of constrained device 106 visually detects an environmental factor in the form of a large body of standing water 192 left behind by a recent flood. This determination of standing water near constrained device 106 is sent to perimeter mod 304, which uses its machine logic based rules (not separately shown in the Figures) to change the shape of the 300 foot radius circular perimeter so that it is no nearer than 25 feet with respect to standing water 192.

Third, environmental factor sub-mod 305 of perimeter mod 304 determines through communication with external information sources (not shown in the Figures) through network 114 (see FIG. 1) that there is a road 191 running through second geographic area 199*b*. In response to this environmental factor, machine logic rules of perimeter module 304 again change the shape of perimeter 190*b* so that all of perimeter 190*b* is at least 50 feet from the road.

Figure 4B:
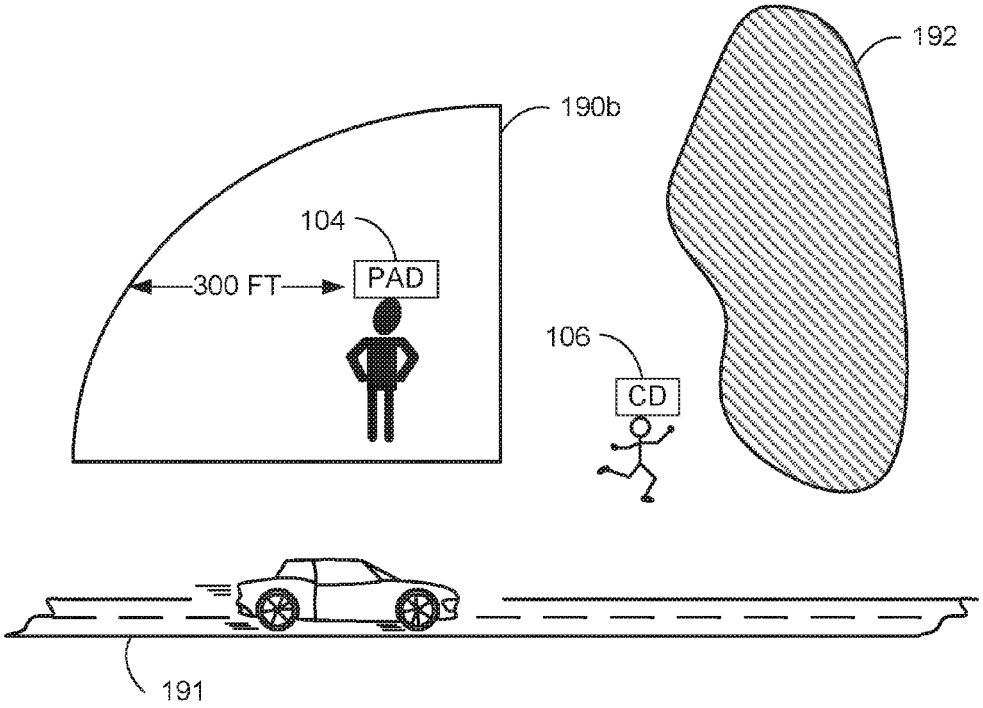
FIG. 4B is a view of people using the first embodiment system at a second geographic location.

The environmental factors, the detection of environmental factors and the specific machine logic rule based responses to environmental factors are intended to be illustrative in nature. In embodiments of the present invention that change the size and/or shape of the perimeter based on environmental factors, there may be many and various types of environmental factors, many and various ways of detecting the environmental factors, and many and various different sets of possible machine logic rules that change the size and/or shape of the dynamic perimeter based on environmental factors. As shown in FIG. 4B, at time T2, constrained device 106 has been carried outside of perimeter 190*b* by the child. This means that at operation S270, comparison mod 306 determines that the constrained device is outside of the current dynamic perimeter. Processing therefore proceeds to operation S275, where alert mod 308 sends a notification and/or alarm to perimeter anchoring device 104 and/or other devices (not shown in the Figures). As will be discussed in the next sub-section of this Detailed Description section, other types of responsive actions are possible.

In the foregoing embodiment, the machine logic is distributed between the perimeter anchoring device, the constrained device and server sub-system 102 (at least in the sense that all three of these devices include machine logic to help determine various environmental factors). However, in the foregoing embodiment, most of the machine logic is located in server sub-system 102. This is not necessarily true, or even necessarily preferred, of all embodiments. For example, in some embodiments, all of the machine logic could be located in the perimeter anchoring device and/or the constrained device, thereby eliminating the need for wide area network 114 and/or server sub-system 102. In embodiments where all the machine logic is distributed among and between the perimeter anchoring device and/or the constrained device, the wireless communication may be similar to wireless communications between conventional "walkie talkies," such that the wireless communication is simplified, and/or designed according to a specialized and/or proprietary standard.

Figure 5:
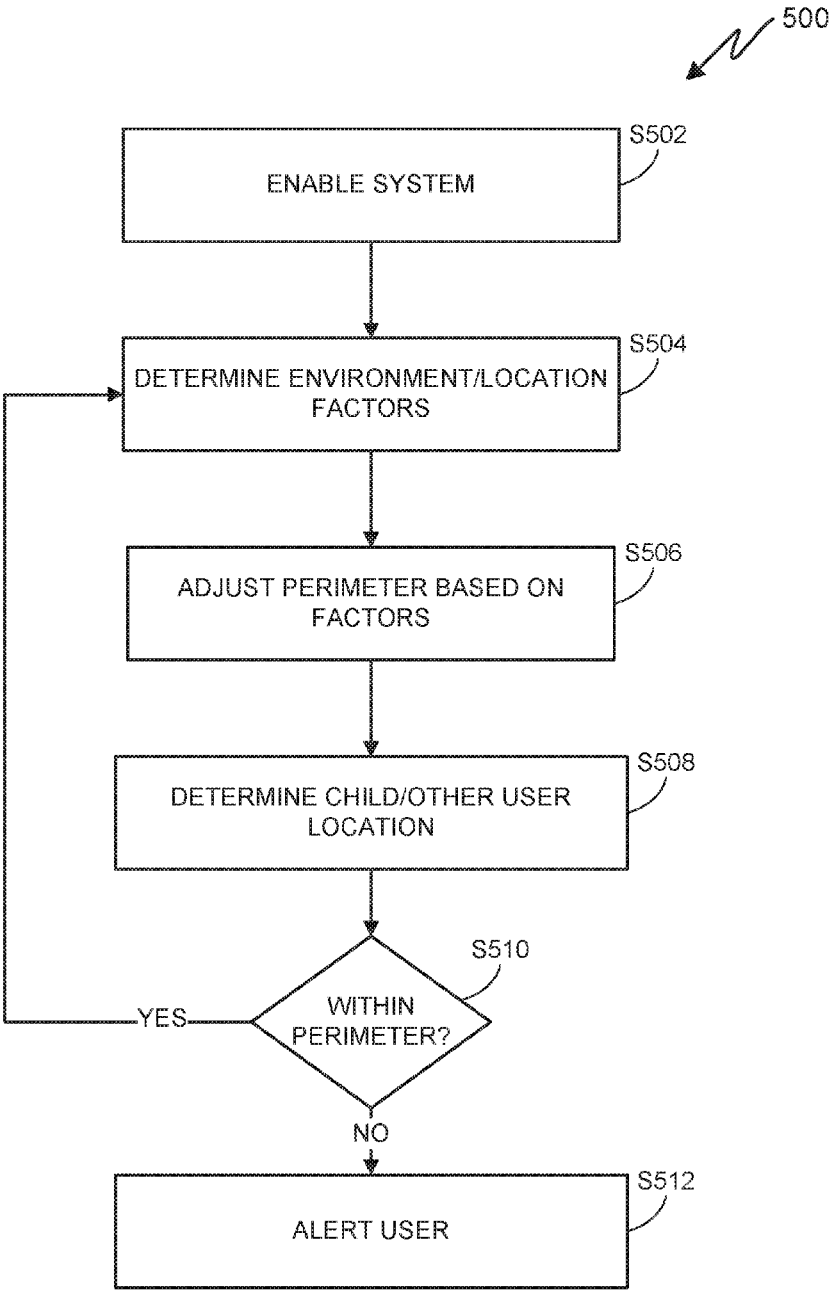
FIG. 5 is a flowchart showing a second embodiment method according to the present invention.

Flowchart 500 of FIG. 5 includes the following operations (with process flow among and between the operations as shown by arrows in FIGS. 5): S502, S504, S506, S508, S510, and S512.

III. FURTHER COMMENTS AND/OR EMBODIMENTS

Some embodiments of the present invention may include one, or more, of the following features, characteristics and/or advantages: (i) a system that dynamically changes the perimeter for an alert/notification system based on location and environment factors; (ii) the factors can include noise level, vehicle movement, train tracks or major roads from a map, water (for example, standing water, flowing water, the ocean), light or darkness, quantity of people, bridge etc.; (iii) the system can adjust the perimeter based on the intensity of an environment factor (for example, of the noise level) or other level of danger (for example, major intersection or road); (iv) as the noise level (for example, measured in decibels) increases, the proximity threshold decreases (for example, decreases by a proportional amount); (v) consideration of how noisy the level is for the child and parent to determine if the child could hear the parent call; (vi) consideration of the child's age or other information that could indicate a level of competency or awareness; (vii) in some embodiments, as the child grows, the proximity may not decrease as much as earlier years under noisy conditions (for example, a 5 year old near a major intersection would want to be kept further away from busy highways than a child that is 12 years old because when someone is older, they are more likely to know better to not go running into the a busy road); (viii) allowing one, or more, of the foregoing features to be enabled or disabled by the parent user; and/or (ix) allow the parent user to configure the system for specific types of locations or environmental conditions.

With respect to item (ix) in the list of the preceding paragraph, for example the user could specify they want the distance proximity set at 60 feet for low noise levels. In this way, the system can use that as a basis, and then adjust accordingly for different conditions.

Two fictitious scenarios will now be described to illustrate aspects of some embodiments of the present invention.

Scenario 1: (i) a child possesses an electronic device (for example, a smart watch) that can communicate its location, ambient noise level, and potential traffic danger (based on nearby vehicle numbers, movement, speed and/or noise); (ii) a parent has configured a circular perimeter, centered on, and moving with the parent, with a radius of 20 feet, in an environment with a noise level below a predefined threshold; (iii) the system detects a noise level above the predefined threshold; (iv) in response, the system reduces the perimeter radius to 10 feet; (v) the child is outside the 10 foot perimeter, or wanders from inside to outside the perimeter; (vi) in response, the system alerts child and parent.

Scenario #2: (i) a child possesses an electronic device (for example, a smart watch) that can communicate its location, ambient noise level, and potential traffic danger (based on nearby vehicle numbers, movement, speed and/or or noise); (ii) a parent has configured a circular perimeter, with a radius of 20 feet, centered on the child, when there are no strangers in the vicinity; (iii) the system detects that everyone within 40 feet are known to the parent (based on factors that include voice recognition, visual recognition, etc.); (iv) the system detects the arrival of additional people in the vicinity (v) in response, the system reduces the perimeter radius to 5 feet; (vi) the parent is now outside the reduced perimeter; (vii) the system alerts child and parent.

Some embodiments of the present invention may include one, or more, of the following features, characteristics and/or advantages: (i) define "situation fencing" as a mechanism to trigger alerts based on the personalized situation for each user (for example, child user and/or parent user); (ii) a "personalized situation" in this context may refer to an actionable integration of a user's personal context with surrounding geo-temporal data; (iii) provide a "variable leash length perimeter" where a child's distance from a parent can vary based on location and human sensory data; (iv) a perimeter that limits how far a mobile device on a child can go from a parent before an alert would occur; and/or (v) consideration of human sensory factors (for example, environmental conditions that impact sensory abilities, data such as noise level and sight).

Some embodiments of the present invention may include one, or more, of the following features, characteristics and/or advantages: (i) dynamic perimeter determination; (ii) perimeter dynamically changed based on noise levels, ratio of known to unknown people in the vicinity, etc.; (iii) a virtual perimeter (or "virtual fence") not based on a fixed location (for example, moves with movements of a parent); (iv) no requirement of having cell phones, cell towers and/or GPS (global positioning system); (v) dynamic change of the perimeter based on many factors like noise level (too much crowd, etc.), location (for example, train tracks/major roads, etc.), strangers, traffic or other hazards and other environment factors; (vi) dynamic perimeter which can be set based on many factors (for example, child age, child mental awareness, safe zone levels like crowd levels, rail zones, major intersections, outside parties, strangers around, etc.); (vii) based on relevant factors some embodiments suggest a perimeter value; and/or (viii) in some embodiments, a parent user can set a perimeter value (for example, by overriding an automatic perimeter suggestion) based on their comfort zone so that they can get alarm if child is at the border or out of the perimeter.

Some embodiments of the present invention may include one, or more, of the following features, characteristics and/or advantages: (i) use of image, voice recognition and/or "social checkins" with a person to estimate ratio of known to unknown persons in the vicinity; (ii) implementation of image detection using wearable technology (for example, computerized glasses); (iii) use of "eyes in the back of your head" type cameras to detect a person's entire surroundings; (iv) use of line of sight to determine, or help determine, a perimeter size and/or shape; (v) when the potential for line of sight to be interrupted increases for more than a few seconds, the perimeter decreases so the child can be within a very close distance when the potential for the child to get lost in the crowd (things, people, cars, etc.) is greatest; and/or (vi) use of "human sensory" inputs to represent the noise and line of sight components.

A scenario according to one embodiment of the present invention is as follows: (i) a child has an electronic device in the form of a smart watch (alternatively, the device could take the form of something attached to the child's clothes) that can communicate its location, noise level, and traffic danger (detected, in this embodiment, by vehicle movement and noise); (ii) the child's parent has configured the perimeter to be 20 feet (specifically a circular perimeter having a radius of 20 feet) when there are no strangers around; (iii) the system detects the known/unknown status of everyone within 40 feet of the child's smart watch (specifically by voice recognition, "check ins," etc.); (iv) the system detects multiple new people in the area (new voice or visual recognition); (v) the system detects that the noise level has increased; (vi) in response to the previous two items on this list, the system adjusts the perimeter down 5 feet (that is, circular perimeter with 15 foot radius); (vii) the child wanders such that the child's parent is outside the 15 foot radius perimeter; and (viii) response action is taken including one, or more, of the following: (a) alarm sounds and is displayed on parent's device, (b) alarm sounds and/or is displayed on child's device, (c) email is automatically sent to child's other parent, (d) GPS location of child's smart watch location appears on both parents' devices, (e) five cents is deducted from child's weekly allowance (and this is displayed to child on her smart watch) and/or (f) other responsive actions.

Some embodiments of the present invention may include one, or more, of the following features, characteristics and/or advantages: (i) perimeter surrounds and moves with a moving, protected person; (ii) perimeter changes based on noise and potentially threatening person's identity relative to protected person's identity; (iii) dynamic changing of size and/or shape of a perimeter based noise, line of sight, quantity of known versus unknown people between two devices/people.

Some embodiments of the present invention may include one, or more, of the following features, characteristics and/or advantages: (i) a method for a dynamic perimeter alert determined by environment and location factors; (ii) monitoring environmental factors between a first device and a second device comprising noise and line of sight; (iii) comparing the environmental factors to a set of environmental context based criteria; (iv) responsive to detecting at least one environmental factor exceeding a context based criteria, performing a notification action (that is, an alert); (v) adjusting the context based criteria to reflect a noise level and an unknown person (for example, a noise level might be allowed at a specific distance without an unknown person, but is not acceptable with an unknown person detected); (vi) consideration of environmental factor(s), such as strangers, street, water, pollution, contamination, allergen, noise exceeding a threshold, blocking obstructions, etc.; (vii) a method for a dynamic perimeter alert determined by environment and location factors; and/or (viii) monitoring environmental factors between a first device and a second device comprising noise and line of sight.

IV. DEFINITIONS

Present invention: should not be taken as an absolute indication that the subject matter described by the term "present invention" is covered by either the claims as they are filed, or by the claims that may eventually issue after patent prosecution; while the term "present invention" is used to help the reader to get a general feel for which disclosures herein are believed to potentially be new, this understanding, as indicated by use of the term "present invention," is tentative and provisional and subject to change over the course of patent prosecution as relevant information is developed and as the claims are potentially amended.

Embodiment: see definition of "present invention" above—similar cautions apply to the term "embodiment."

and/or: inclusive or; for example, A, B "and/or" C means that at least one of A or B or C is true and applicable.

Including/include/includes: unless otherwise explicitly noted, means "including but not necessarily limited to."

Data communication: any sort of data communication scheme now known or to be developed in the future, including wireless communication, wired communication and communication routes that have wireless and wired portions; data communication is not necessarily limited to: (i) direct data communication; (ii) indirect data communication; and/or (iii) data communication where the format, packetization status, medium, encryption status and/or protocol remains constant over the entire course of the data communication.

Module/Sub-Module: any set of hardware, firmware and/or software that operatively works to do some kind of function, without regard to whether the module is: (i) in a single local proximity; (ii) distributed over a wide area; (iii) in a single proximity within a larger piece of software code; (iv) located within a single piece of software code; (v) located in a single storage device, memory or medium; (vi) mechanically connected; (vii) electrically connected; and/or (viii) connected in data communication.

Computer: any device with significant data processing and/or machine readable instruction reading capabilities including, but not limited to: desktop computers, mainframe computers, laptop computers, field-programmable gate array (FPGA) based devices, smart phones, personal digital assistants (PDAs), body-mounted or inserted computers, embedded device style computers, application-specific integrated circuit (ASIC) based devices.

Wirelessly sending: sending information over a communication path that includes at least one wireless link; the communication path may include wired links in addition to the at least one wireless link.

What is claimed is:

1. A method comprising:

providing a perimeter-anchoring device and a constrained device, with each of the perimeter-anchoring and constrained devices:

being structured, sized and/or shaped to be portable, and including a location determination module structured and/or programmed to determine a current geographic location of the device;

receiving, from the location determination module of the constrained device, the current geographic location of the constrained device;

monitoring, by an environmental factor module, a first environmental factor, based at least in part upon the current geographic location of at least one of the following: the constrained device and the perimeter-anchoring device;

receiving, from the location determination module of the perimeter-anchoring device, the current geographic location of the perimeter-anchoring device;

determining, by a perimeter module on an on-going basis, a geographic area, based at least in part upon the first environmental factor, with: (i) the geographic area being bounded by a perimeter so that the area and perimeter will dynamically move with any movements of the current geographic location of the perimeter-anchoring device, and (ii) the perimeter-anchoring device being located outside the geographic area;

determining, by a comparison module, whether the constrained device is located outside of the perimeter, based at least in part upon the current geographic location of the constrained device and the current geographic location of the perimeter-anchoring device; and on condition that the constrained device is located outside of the perimeter, performing, by an alerting module, a responsive action.

2. The method of claim 1 wherein:

the perimeter module, the comparison module and the alerting module are all located in the perimeter-anchoring device; and receipt of the current geographic location of the constrained device is accomplished by the location determination module of the constrained device wirelessly sending the current geographic location of the constrained device to the comparison module of the perimeter-anchoring device.

3. The method of claim 1 wherein:

the perimeter module, the comparison module and the alerting module are all located in the constrained device; and receipt of the current geographic location of the perimeter-anchoring device is accomplished by the location determination module of the perimeter-anchoring device wirelessly sending the current geographic location of the perimeter-anchoring device to the perimeter module of the constrained device.

4. The method of claim 1 wherein:

the perimeter module, the comparison module and the alerting module are all located in a control device that is remote from both of the perimeter-anchoring device and the constrained device;

receipt of the current geographic location of the perimeter-anchoring device is accomplished by the location determination module of the perimeter-anchoring device wirelessly sending the current geographic location of the perimeter-anchoring device to the perimeter module of the control device; and receipt of the current geographic location of the constrained device is accomplished by the location determination module of the constrained device wirelessly sending the current geographic location of the constrained device to the comparison module of the control device.

5. The method of claim 1 wherein the determination of the perimeter by the perimeter module determines a shape of the perimeter, based at least in part upon the first environmental factor.

6. The method of claim 1 wherein the determination of the perimeter by the perimeter module determines a size of the perimeter, based at least in part upon the first environmental factor.

7. The method of claim 1 wherein the environmental factor module is located, at least in part, in the constrained device.

8. The method of claim 1 wherein the first environmental factor is one of the following: line of sight, pollution, noise level, presence of stranger(s), streets, traffic, body(ies) of water, contamination, allergens, or blocking obstruction(s).

9. The method of claim 1 wherein the responsive action includes making a notification.

10. A computer program product for use with a perimeter-anchoring device and a constrained device, with each of the perimeter-anchoring and constrained devices being structured, sized and/or shaped to be portable, and including a location determination module structured and/or programmed to determine a current geographic location of the device, the computer program product comprising:

a storage device; and machine readable instructions stored on and/or in the storage device;

wherein the machine readable instructions include the following:

a first receiving module programmed to receive, from the location determination module of the perimeter-anchoring device, the current geographic location of the perimeter-anchoring device, a second receiving module programmed to receive, from the location determination module of the constrained device, the current geographic location of the constrained device, an environmental factor module structured and/or programmed to determine a current environmental factor in the vicinity of the device, to monitor a first environmental factor, based at least in part upon the current environment in the vicinity of at least one of the following: the constrained device and the perimeter-anchoring device, a perimeter module programmed to, on an on-going basis, determine a geographic area, based at least in part upon the first environmental factor, with: (i) the geographic area being bounded by a perimeter so that the area and perimeter will dynamically move with any movements of the current geographic location of the perimeter-anchoring device, and (ii) the perimeter-anchoring device being located outside the geographic area, a comparison module programmed to determine whether the constrained device is located outside of the perimeter, based at least in part upon the current geographic location of the constrained device and the current geographic location of the perimeter-anchoring device, and an alerting module, programmed to, on condition that the constrained device is located outside of the perimeter, perform a responsive action.

11. The computer program product of claim 10 wherein:

the perimeter module, the comparison module and the alerting module are all located in the perimeter-anchoring device; and receipt of the current geographic location of the constrained device is accomplished by the location determination module of the constrained device wirelessly sending the current geographic location of the constrained device to the comparison module of the perimeter-anchoring device.

12. The computer program product of claim 10 wherein:

the perimeter module, the comparison module and the alerting module are all located in the constrained device; and receipt of the current geographic location of the perimeter-anchoring device is accomplished by the location determination module of the perimeter-anchoring device wirelessly sending the current geographic location of the perimeter-anchoring device to the perimeter module of the constrained device.

13. The computer program product of claim 10 wherein:

the perimeter module, the comparison module and the alerting module are all located in a control device that is remote from both of the perimeter-anchoring device and the constrained device;

receipt of the current geographic location of the perimeter-anchoring device is accomplished by the location determination module of the perimeter-anchoring device wirelessly sending the current geographic location of the perimeter-anchoring device to the perimeter module of the control device; and receipt of the current geographic location of the constrained device is accomplished by the location determination module of the constrained device wirelessly sending the current geographic location of the constrained device to the comparison module of the control device.

14. The computer program product of claim 10 wherein the perimeter module is further programmed to determine a shape of the perimeter, based at least in part upon the first environmental factor.

15. The computer program product of claim 10 wherein the perimeter module is further programmed to determine a size of the perimeter, based at least in part upon the first environmental factor.

16. The computer program product of claim 10 wherein the environmental factor module is located, at least in part, in the constrained device.

17. The computer program product of claim 10 wherein the first environmental factor is one of the following: line of sight, pollution, noise level, presence of stranger(s), streets, traffic, body(ies) of water, contamination, allergens, or blocking obstruction(s).

18. A computer system for use with a perimeter-anchoring device and a constrained device, with each of the perimeter-anchoring and constrained devices being structured, sized and/or shaped to be portable, and including a location determination module structured and/or programmed to determine a current geographic location of the device, the computer system comprising:

a processor(s) set; and a computer readable storage medium;

wherein:

the processor(s) set is structured, located, connected and/or programmed to execute instructions stored on the computer readable storage medium; and the instructions include:

a first receiving module programmed to receive, from the location determination module of the perimeter-anchoring device, the current geographic location of the perimeter-anchoring device, a second receiving module programmed to receive, from the location determination module of the constrained device, the current geographic location of the constrained device, an environmental factor module structured and/or programmed to determine a current environmental factor in the vicinity of the device, to monitor a first environmental factor, based at least in part upon the current environment in the vicinity of at least one of the following: the constrained device and the perimeter-anchoring device, a perimeter module programmed to, on an on-going basis, determine a geographic area, based at least in part upon the first environmental factor, with: (i) the geographic area being bounded by a perimeter so that the area and perimeter will dynamically move with any movements of the current geographic location of the perimeter-anchoring device, and (ii) the perimeter-anchoring device being located outside the geographic area, a comparison module programmed to determine whether the constrained device is located outside of the perimeter, based at least in part upon the current geographic location of the constrained device and the current geographic location of the perimeter-anchoring device, and an alerting module, programmed to, on condition that the constrained device is located outside of the perimeter, perform a responsive action.

* * * * *